US008287257B2

(12) United States Patent
Dunaevsky

(10) Patent No.: US 8,287,257 B2
(45) Date of Patent: Oct. 16, 2012

(54) OLDHAM COUPLING

(75) Inventor: Valery Dunaevsky, Eden Prairie, MN (US)

(73) Assignee: Thermo King Corporation, Minneapolis, MN (US)

( * ) Notice: Subject to any disclaimer, the term of this patent is extended or adjusted under 35 U.S.C. 154(b) by 553 days.

(21) Appl. No.: 12/545,448

(22) Filed: Aug. 21, 2009

(65) Prior Publication Data

US 2011/0044833 A1 Feb. 24, 2011

(51) Int. Cl.

| | |
|---|---|
| ***F03C 2/00*** | (2006.01) |
| ***F03C 4/00*** | (2006.01) |
| ***F04C 2/00*** | (2006.01) |

(52) U.S. Cl. ..... 418/55.3; 418/55.1; 418/151; 464/102

(58) Field of Classification Search ..... 418/55.1–55.6, 418/57, 151; 464/102

See application file for complete search history.

(56) References Cited

U.S. PATENT DOCUMENTS

| | | | | |
|---|---|---|---|---|
| 5,320,506 | A | 6/1994 | Fogt | |
| 5,403,172 | A * | 4/1995 | Blass et al. | 418/55.3 |
| 6,079,962 | A * | 6/2000 | Seibel et al. | 418/55.3 |

FOREIGN PATENT DOCUMENTS

JP 05149265 A * 6/1993

OTHER PUBLICATIONS

JP 05149265 A Hibi et al.—Scroll Type Compressor—Jun. 15, 1993—English Translation (Machine Translation).*

* cited by examiner

*Primary Examiner* — Theresa Trieu

(74) *Attorney, Agent, or Firm* — Michael Best & Friedrich LLP

(57) ABSTRACT

A rotary compressor including a housing, a first scroll member, a second scroll member in meshing engagement with the first scroll member, and an Oldham coupling coupled to the second scroll member to inhibit the relative rotational movement between the first scroll member and the second scroll member. The Oldham coupling including a first riding pad, a second riding pad, a third riding pad is positioned, and a fourth riding pad positioned such that the first riding pad and the fourth riding pad are in an overlapping arrangement.

26 Claims, 4 Drawing Sheets

OLDHAM COUPLING

BACKGROUND

This application relates to an Oldham coupling for a scroll compressor. In particular, this application relates to a scroll compressor used in a refrigeration system, although the invention is not limited in use to refrigeration systems.

In typical scroll compressors, a first, stationary, scroll member has a base and a generally spiral wrap extending from its base. A second, orbiting, scroll member has a base and a generally spiral wrap extending from its base. The second scroll member is driven to orbit by a rotating shaft. An eccentric pin on the shaft extends into a slider block which is received within a boss on a rear face of the second scroll member. A special coupling, known as an Oldham coupling, allows the second scroll member to orbit relative to the first scroll member when driven by the rotating shaft. As the second scroll member orbits relative to the first, compression chambers defined between the wraps of the first and second scroll member decrease in size to compress the refrigerant.

Typical Oldham couplings may demonstrate a fatigue failure in the web structure when one or more guides or keys become worn.

Fatigue failure of the Oldham Coupling across its web structure is a critical failure mode of the coupling. Quite often wear of one or more guides or keys precedes the failure. Poor lubrication conditions may promote wear and subsequent fatigue failure of the Oldham coupling, particularly during a low speed defrost often associated with a liquid refrigerant flood back. An Oldham coupling with worn keys reorients itself in a position that induces extra loads on the web leading, potentially, to its fracture. However, fracture of the web has been observed even with non-worn keys. Accordingly, the keys' wear was considered a major precursor of the failure in former attempts to resolve the issue of fracture in the web. Earlier attempts to eliminate failure of the coupling were concentrated on reducing wear of the keys by utilizing wear resistant coatings on the keys and reducing access of a liquid refrigerant to the area of keys/scroll interaction.

SUMMARY

The invention provides an Oldham coupling of increased fracture resistance independent of key wear, as described below.

In one embodiment, the invention provides a rotary compressor that includes a housing including a fluid inlet and a fluid outlet, a first scroll member within the housing and positioned between the fluid inlet and the fluid outlet, a second scroll member within the housing, positioned between the fluid inlet and the fluid outlet, and in meshing engagement with the first scroll member to compress a fluid from a first pressure in the inlet to a second higher pressure at the outlet, and an Oldham coupling positioned within the housing and coupled to the second scroll member to inhibit the relative rotational movement between the first scroll member and the second scroll member. The Oldham coupling includes an annular ring that includes an upper surface, a lower surface, a first arc segment, a second arc segment, a first outwardly projecting flange portion extending out from the second arc segment, and a second outwardly projecting flange portion extending out from the second arc segment. A first key is positioned on the upper surface and centered with respect to the first arc segment, a second key is positioned on the upper surface and centered with respect to the second arc segment, a third key is positioned on the upper surface of the first outwardly projecting flange portion, and a fourth key is positioned on the upper surface of the second outwardly projecting flange portion. A first riding pad is positioned on the upper surface and is adjacent the first key, a second riding pad is positioned on the upper surface and is adjacent the third key, a third riding pad is positioned on the lower surface and is adjacent the third key, and a fourth riding pad is positioned on the lower surface and is adjacent the first key such that the first riding pad and the fourth riding pad are in an overlapping arrangement.

In another embodiment the invention provides a rotary compressor that includes a housing including a fluid inlet and a fluid outlet, a first scroll member within the housing and positioned between the fluid inlet and the fluid outlet, a second scroll member within the housing, positioned between the fluid inlet and the fluid outlet, and in meshing engagement with the first scroll member to compress a fluid from a first pressure in the inlet to a second higher pressure at the outlet, and an Oldham coupling positioned within the housing and coupled to the second scroll member to inhibit the relative rotational movement between the first scroll member and the second scroll member. The Oldham coupling includes an annular ring that includes an upper surface, a lower surface, a first arc segment, a second arc segment, a first outwardly projecting flange portion extending out from the second arc segment, and a second outwardly projecting flange portion extending out from the second arc segment. A first key is positioned on the upper surface and centered with respect to the first arc segment, a second key is positioned on the upper surface and centered with respect to the second arc segment, a third key is positioned on the upper surface of the first outwardly projecting flange portion, and a fourth key is positioned on the upper surface of the second outwardly projecting flange portion. A first riding pad is positioned on the upper surface adjacent the first key and occupies at least twelve percent of the first arc segment, a second riding pad is positioned on the upper surface adjacent the third key, a third riding pad is positioned on the lower surface adjacent the third key and occupies at least twenty percent of the second arc segment, and a fourth riding pad is positioned on the lower surface adjacent the first key and occupies at least twenty percent of the first arc segment.

In another embodiment the invention provides an Oldham coupling that includes an annular ring with an upper surface, a lower surface, a first arc segment, a second arc segment, a first outwardly projecting flange portion extending out from the second arc segment, and a second outwardly projecting flange portion extending out from the second arc segment. A first key is positioned on the upper surface and is centered with respect to the first arc segment, a second key is positioned on the upper surface and centered with respect to the second arc segment, a third key is positioned on the upper surface of the first outwardly projecting flange portion, and a fourth key is positioned on the upper surface of the second outwardly projecting flange portion. A first riding pad is positioned on the upper surface, occupies at least twelve percent of the first arc segment, and is adjacent the first key, a second riding pad is positioned adjacent the third key, a third riding pad is positioned on the lower surface, occupies at least twenty percent of the second arc segment, and is adjacent the third key such that the second riding pad and the third riding pad are in an overlapping arrangement, and a fourth riding pad is positioned on the lower surface, occupies at least twenty percent of the first arc segment, and is adjacent the first key such that the first riding pad and the fourth riding pad are in an overlapping arrangement.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
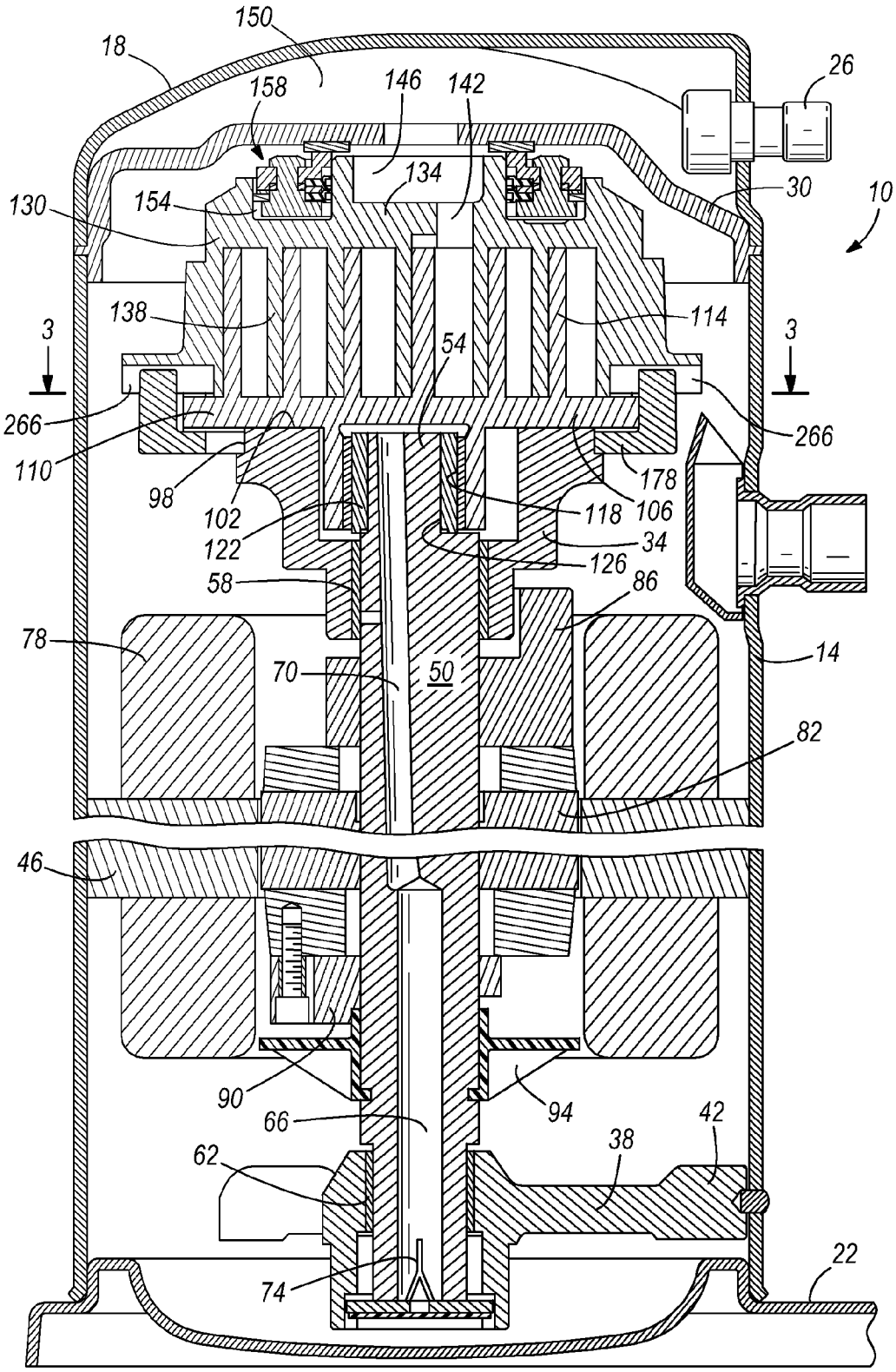
FIG. 1 is a sectional view of a scroll compressor including an Oldham coupling according to the invention.

Referring now to the drawings and in particular to FIG. 1, a compressor 10 is shown which comprises a generally cylindrical hermetic shell 14 having welded at the upper end thereof a cap 18 and at the lower end thereof a base 22 having a plurality of mounting feet (not shown) integrally formed therewith. The cap 18 is provided with a refrigerant discharge fitting 26 which may include a discharge valve therein (not shown), as desired. Other major elements coupled to the shell 14 include a transversely extending partition 30 which is welded about its periphery at the same point that the cap 18 is welded to the shell 14, a main bearing housing 34 secured to the shell 14, and a lower bearing housing 38 having a plurality of radially outwardly extending legs 42 each of which is secured to the shell 14. A motor stator 46 with a generally square cross section is press-fitted into the shell 14. Passageways (not shown) are formed between the motor stator 46 and the shell 14 to facilitate the flow of a lubricant from the top of the shell 14 to the bottom.

A drive shaft or crankshaft 50 having an eccentric crank pin 54 at the upper end thereof is rotatably journaled in a bearing 58 in the main bearing housing 34 and a second bearing 62 in the lower bearing housing 38. The crankshaft 50 has at the lower end a relatively large diameter concentric bore 66 which communicates with a radially outwardly inclined smaller diameter bore 70 extending upwardly therefrom to the top of the crankshaft 50. Disposed within the large concentric bore 66 is a stirrer 74. The lower portion of the interior shell 14 is filled with lubricating oil and the large concentric bore 66 acts as a pump to pump lubricating fluid up the crankshaft 50 and into a passageway and ultimately to all of the various portions of the compressor 10 which require lubrication.

Crankshaft 50 is driven by an electric motor including the motor stator 46, windings 78 passing therethrough, and a rotor 82 press-fit on the crankshaft 50. Upper and lower counterweights 86 and 90 are coupled to the crankshaft 50. A counterweight shield 94 may be provided to reduce the work loss caused by the counterweight 90 spinning in the oil in the sump.

The main bearing housing 34 includes a generally cylindrical upper portion 98 that defines a flat thrust bearing surface 102 on which is supported an orbiting scroll member 106 having an end plate 110 and spiral vane or wrap 114 projecting from the upper surface thereof. Projecting downwardly from the lower surface of the end plate 110 of orbiting scroll 106 is a cylindrical hub having a journal bearing 118 therein and in which is rotatively disposed a drive bushing 122 having an inner bore 126 in which crank pin 54 is drivingly disposed. The crank pin 54 has a flat on one surface which drivingly engages a flat surface (not shown) formed in a portion of bore 126 to provide a radially compliant driving arrangement therebetween such that the crank pin 54 and the drive bushing 122 do not substantially rotate relative to one another.

A non-orbiting scroll member 130 includes an end plate 134 and a wrap 138 projecting therefrom which is positioned in meshing engagement with the wrap 114 of the orbiting scroll 106. The non-orbiting scroll member 130 has a centrally disposed discharge passage 142 which communicates with an upwardly open recess 146 which in turn is in fluid communication with a discharge muffler chamber 150 defined by the cap 18 and the partition 30. An annular recess 154 is also formed in the non-orbiting scroll 64 within which is disposed a seal assembly 158. The recesses 146, 154 and the seal assembly 158 cooperate to define axial pressure biasing chambers which receive pressurized fluid being compressed by the wraps 114 and 138 so as to exert an axial biasing force on the non-orbiting scroll member 130 to thereby urge the tips of the respective wraps 114, 138 into sealing engagement with the opposed end plates 110, 134.

Figure 2:
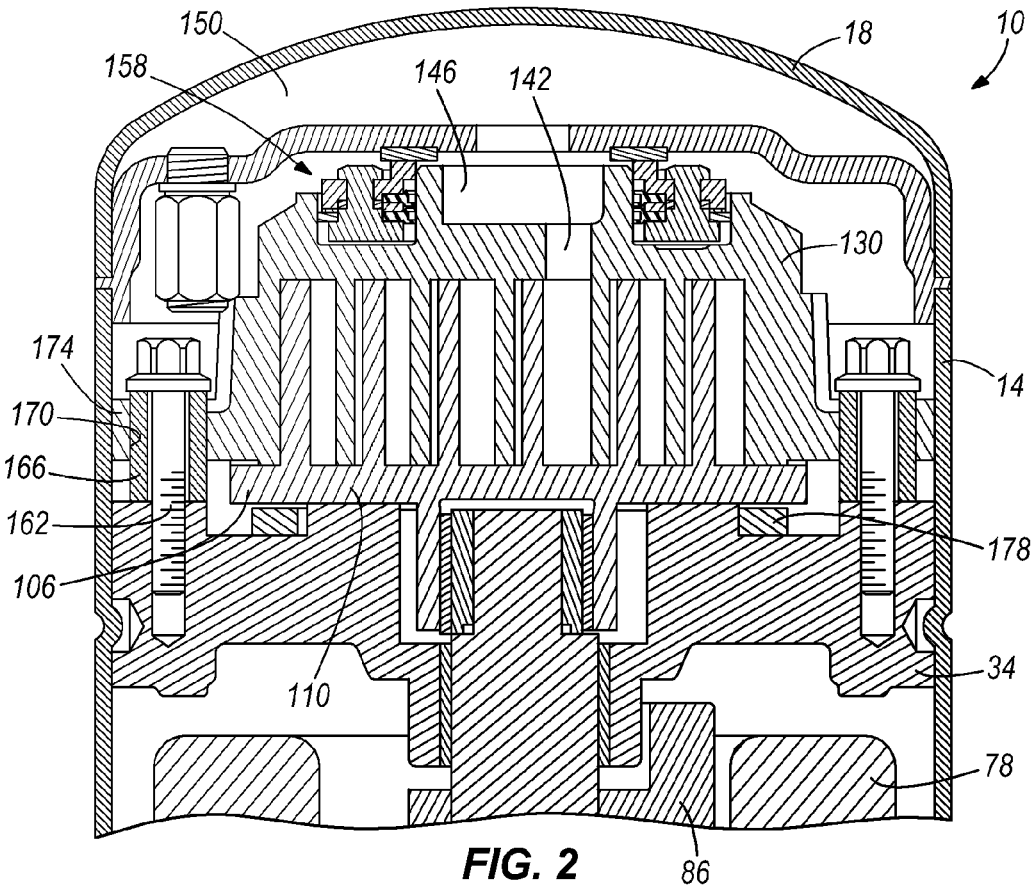
FIG. 2 is another sectional view of the scroll compressor of FIG. 1.

As best seen with reference to FIG. 2, non-orbiting scroll member 130 is designed to be mounted to the bearing housing 34 by means of a plurality of circumferentially spaced bolts 162 extending through respective bushings 166 which are slidably fitted within bores 170 provided in a radially outwardly projecting flange portion 174 integrally formed on the non-orbiting scroll member 130. Preferably, the length of the bushings 166 will be such as to provide a slight clearance between the lower surface of the head of the bolts 162 and the upper surface of the flange portion 174 so as to allow a slight axial movement of the non-orbiting scroll member 130 in a direction away from the orbiting scroll member 106.

In order to prevent relative rotation between the scroll members 106 and 130, an Oldham coupling 178 is provided being positioned in surrounding relationship to the cylindrical upper portion 98 of the main bearing housing 34 and immediately below the end plate 110 of the orbiting scroll member 106. The illustrated Oldham coupling 178 is constructed of aluminum, although other materials may be used (e.g., steel), as desired.

Figure 4:
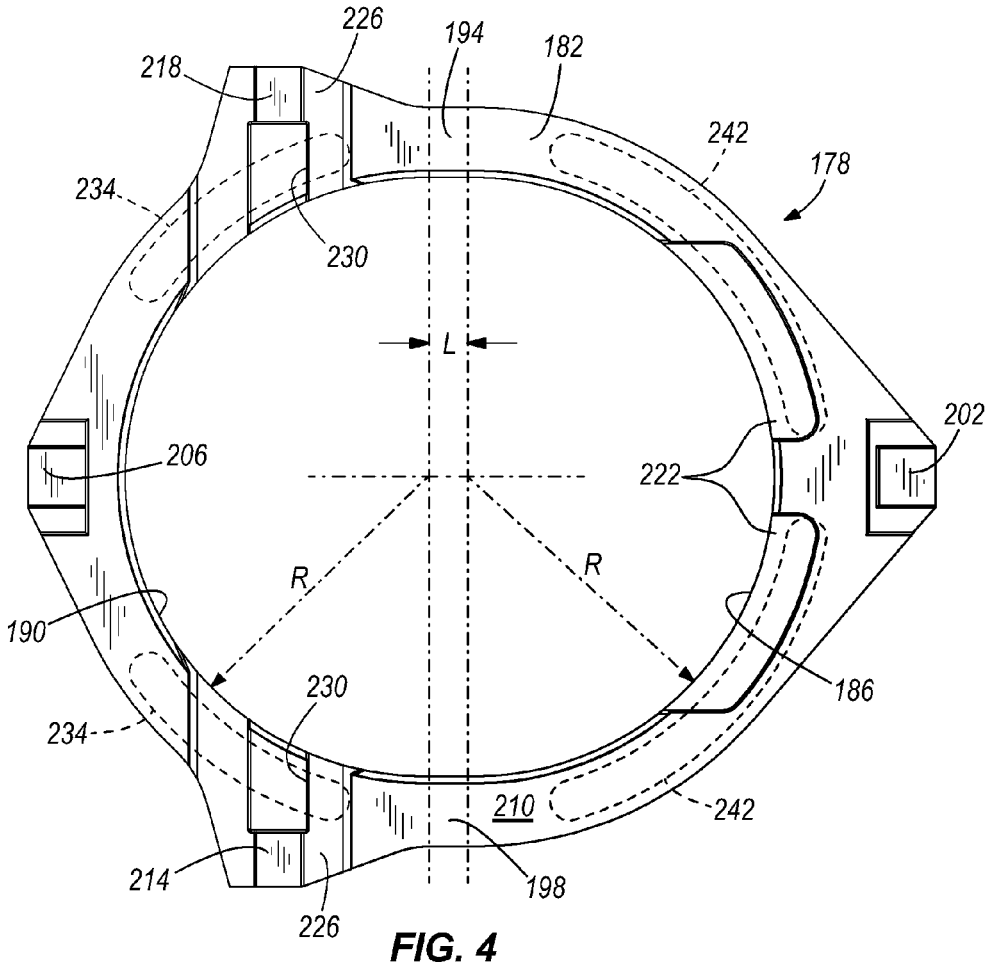
FIG. 4 is a top view of the Oldham coupling of FIG. 1.
Figure 5:
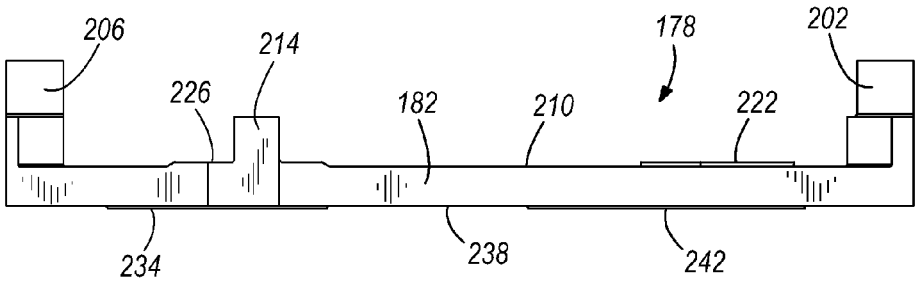
FIG. 5 is a side view of the Oldham coupling of FIG. 1.

As best seen with reference to FIGS. 4 and 5, the Oldham coupling 178 includes an annular ring portion 182, the inner periphery of which is non-circular in shape being defined by two generally circular arc segments 186, 190 each of a substantially constant radius R. The opposed ends of the arc segments 186, 190 are interconnected by substantially straight segments 194, 198 of a length L. Preferably, the radius R of the arc segments 186, 190 is approximately equal to the radius of the cylindrical upper portion 98 provided on the main bearing housing 34 plus a small clearance. The length L of the straight segments 194, 198 is approximately equal to twice the radius of the orbit traveled by the orbiting scroll member 106 plus a slight clearance.

First and second keys 202, 206 are provided on the annular ring 182 in diametrically aligned relationship and projecting axially upwardly from an upper surface 210. Third and fourth keys 214, 218 are also provided on the annular ring 182 and project axially upwardly from the upper surface 210. The third and fourth keys 214, 218 are also aligned along a line extending substantially perpendicular to the diameter along which the first and second keys 202, 206 are aligned but shifted radially toward the second key 206. Both the radial shifting and outward positioning of the third and fourth keys 214, 218 cooperate to enable the size of the Oldham coupling 178 to be kept to a minimum for a given size compressor and associated shell diameter. Such an arrangement also enables the size of the thrust surface 102 to be maximized for this same compressor to avoid interference with the location and extent of the wrap 114 of the orbiting scroll member 106.

The Oldham coupling 178 also includes four pairs of riding pads positioned on the annular ring portion 182. A pair of first riding pads 222 are positioned on the upper surface 210 of the Oldham coupling 178 adjacent the first key 202. Each of the first riding pads 222 extends from the inner radius R of the arc segment 186 toward the outer radius of the annular ring portion 182. The corners of the first riding pads 222 are rounded and the edges include a fillet. In other constructions, the first riding pads 222 may be positioned between the inner radius R and the outer radius with all corners of the first riding pads 222 rounded. In addition, a chamfer may be used in place of the fillet.

The illustrated first riding pads 222 are each about thirty-seven millimeters long and each extends along approximately twenty-four percent of the arc segment 186. In other embodiments, each of the first riding pads 222 extends along approximately eighteen percent of the arc segment 186. In still other embodiments, each of the first riding pads 222 extend along at least twelve percent of the arc segment 186.

A pair of second riding pads 226 are positioned on the upper surface 210 of the Oldham coupling 178 adjacent the third and fourth keys 214, 218. Each of the second riding pads 226 extends substantially from the inner radius R of the arc segment 190 to the distal end of the respective outwardly projecting flange portion 174. A cavity 230 is formed in each of the second riding pads 226 thereby defining two legs flanking the cavity. The edges of the second riding pads 226 include a fillet. In other constructions, a chamfer may be used in place of the fillet.

The illustrated second riding pads 226 are each about thirty-two millimeters long and each extends along approximately twenty-one percent of the arc segment 190. In other embodiments, each of the second riding pads 226 extend along more of the arc segment 190.

A pair of third riding pads 234 are positioned on a lower surface 238 of the Oldham coupling 178 adjacent the third and fourth keys 214, 218. The third riding pads 234 are positioned between the inner radius R and the outer radius and include semi-circular end portions. The third riding pads 234 are positioned in an overlapping arrangement with the second riding pads 226 and in the illustrated embodiment, the third riding pads 234 substantially overlap both legs of the second riding pads 226. The edges of the third riding pads 234 include a fillet. In other constructions, a chamfer may be used in place of the fillet.

The illustrated third riding pads 234 are each about thirty-nine millimeters long and each extends along approximately twenty-five percent of the arc segment 190. In other embodiments, each of the third riding pads 234 extend along approximately twenty-three percent of the arc segment 190. In still other embodiments, each of the third riding pads 234 extend along at least twenty percent of the arc segment 190.

A pair of fourth riding pads 242 are positioned on the lower surface 238 of the Oldham coupling 178 adjacent the first key 202. The fourth riding pads 234 are positioned between the inner radius R and the outer radius and include semi-circular end portions. The fourth and first riding pads 242, 222 are positioned in an overlapping arrangement. The edges of the fourth riding pads 242 include a fillet. In other constructions, a chamfer may be used in place of the fillet.

The illustrated fourth riding pads 242 are each about fifty-nine millimeters long and each extend along approximately thirty-eight percent of the arc segment 186. In other embodiments, each of the fourth riding pads 242 extend along approximately thirty percent of the arc segment 186. In still other embodiments, each of the fourth riding pads 242 extend along at least twenty percent of the arc segment 186.

The overlapping arrangement of the second and third riding pads 226, 234, and first and fourth riding pads 222, 242 is shown clearly in FIG. 4. The third and fourth riding pads 234, 242 are shown in broken lines indicating they are on the lower surface 238. More specifically, if each arc segment 186, 190 is broken down into degrees zero through one-hundred eighty, with zero degrees defined adjacent straight portion 194, the overlapping portions may be defined as follows. The first riding pads 222 occupy approximately degrees forty through eighty-three and degrees ninety-seven through one-hundred-forty. The second riding pads 226 occupy approximately degrees thirteen through fifty-one and degrees one-hundred-twenty-nine through one-hundred-sixty-seven. The third riding pads 234 occupy approximately degrees thirteen through fifty-eight and degrees one-hundred-twenty-two through one-hundred-sixty-seven. The fourth riding pads 242 occupy approximately degrees fourteen through eighty-three and degrees ninety-seven through one-hundred-sixty-six. Therefore it can be observed that the first and fourth riding pads 222, 242 overlap in approximately degrees forty through eighty-three and degrees ninety-seven through one-hundred-forty, and the second and third riding pads 226, 234 overlap in approximately degrees thirteen through fifty-one and degrees one-hundred-twenty-nine through one-hundred-sixty-seven.

Figure 6:
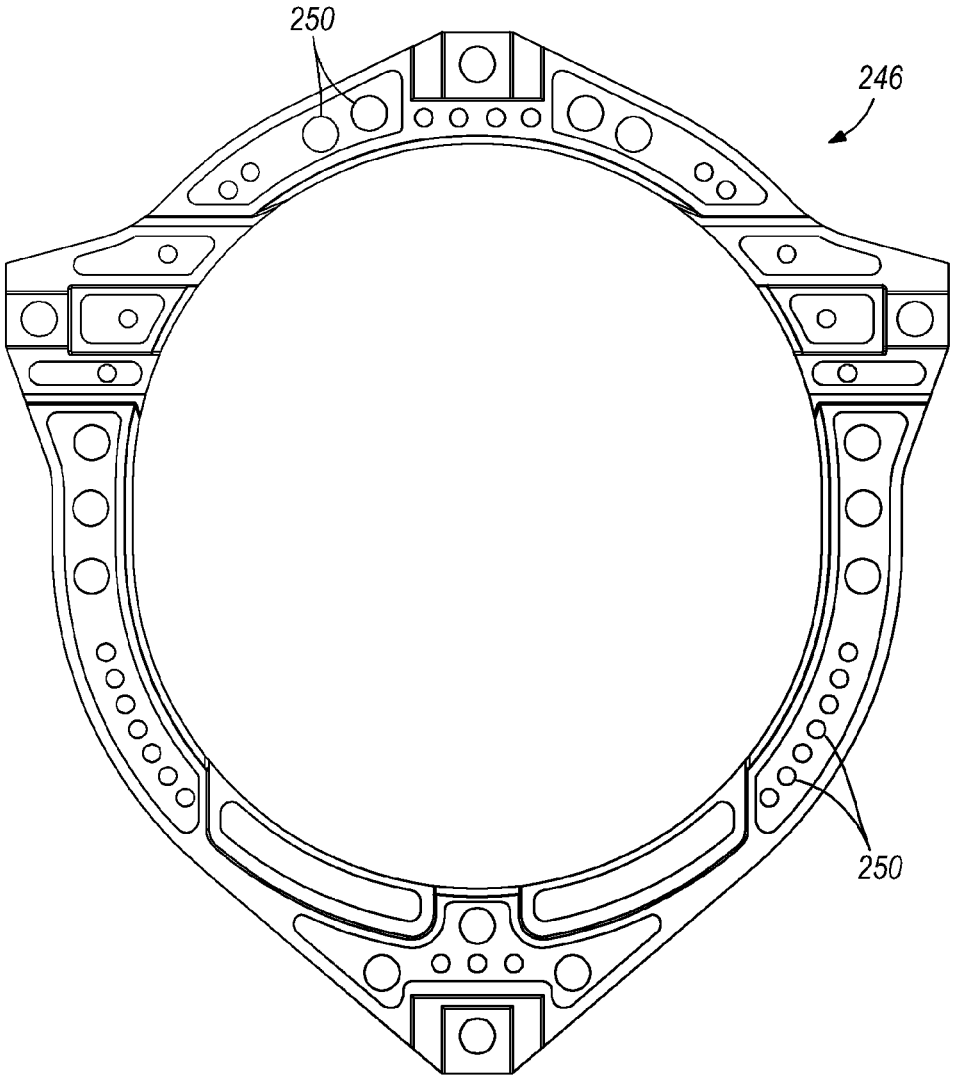
FIG. 6 is another Oldham coupling according to the invention.

The Oldham coupling 178 shown in FIGS. 1-5 is constructed of aluminum. Another Oldham coupling 246 is shown in FIG. 6. The Oldham coupling 246 is constructed of steel and includes a number of apertures 250 to reduce the overall weight of the Oldham coupling 246. The Oldham coupling 246 is similar to the Oldham coupling 178 shown in FIGS. 1-5. In other constructions, another material may be used such as titanium or any other suitable material, as desired.

The illustrated aluminum Oldham coupling 178 is not coated with a wear resistant or hard facing alloy or coating. However, such a coating may be employed. The illustrated steel Oldham coupling 246 does include a wear resistant coating. Exemplary coatings for the aluminum Oldham coupling 178 include E-nickel, anodizing and plasma spraying coatings infiltrated with self-lubricants. The steel Oldham coupling 246 coating is a thin dense chromium layer, specifically the coating is an ARMOLOY® TDC coating available from the Armoloy Corporation of DeKalb, Ill. A combined coating including an ARMOLOY® TDC coating on an E-nickel substrate may be used to apply the ARMOLOY® TDC coating to the aluminum Oldham coupling 178.

Figure 3:
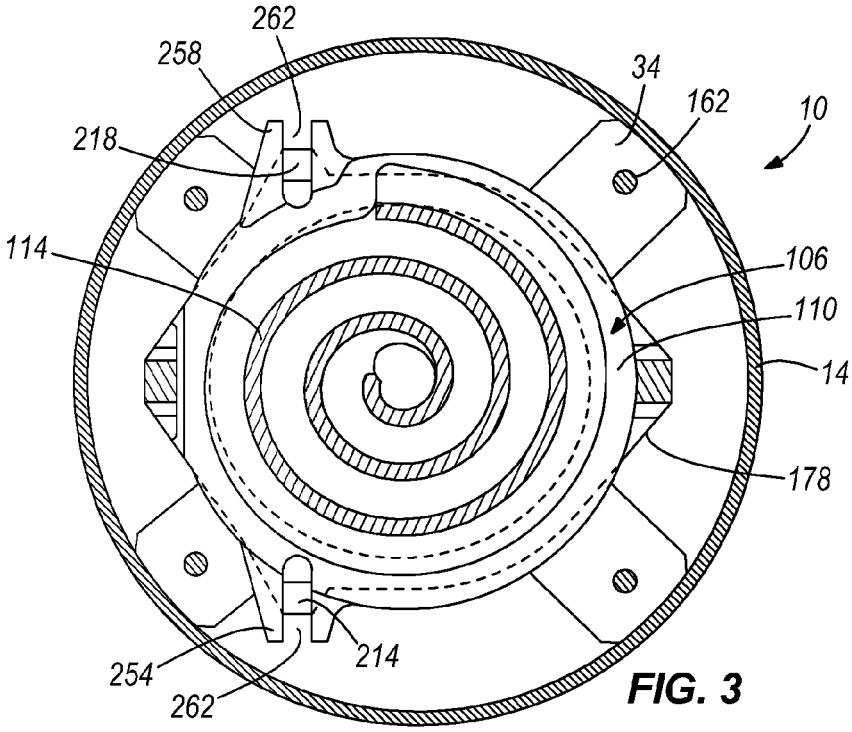
FIG. 3 is a sectional view of the scroll compressor taken along line 3-3 in FIG. 1.

As shown in FIG. 3, the end plate 110 of the orbiting scroll member 106 is provided with a pair of outwardly projecting flange portions 254, 258 each of which is provided with an outwardly opening slot 262. The slots 262 are sized to slidingly receive the third and fourth keys 214, 218. The keys 214, 218 have an axial length or height so as to avoid projecting above the upper surface of the end plate 110 of the orbiting scroll member 106.

Referring once again to FIG. 1, the non-orbiting scroll member 130 is similarly provided with a pair of radially extending aligned slots 266 which are designed to receive the first and second keys 202, 206. The first and second keys 202, 206 will be substantially longer than the third and fourth keys 214, 218 and of sufficient length to project above the end plate 110 of the orbiting scroll member 106 and remain in engagement with the slots 266 throughout the limited axial movement of the non-orbiting scroll member 130 noted above. It should be noted, however, that preferably a slight clearance will be provided between the end of the first and second keys 202, 206 and the overlying surfaces of the respective slots 266 when the non-orbiting scroll member 130 is fully seated against the orbiting scroll member 106 thereby avoiding any possibility of interference with the tip sealing between the respective scroll members 106, 130.

As may now be appreciated, Oldham coupling 178 serves to directly interconnect and prevent any relative rotation between scroll members 106, 130 through the cooperative action of the abutment surfaces provided by the slots 262, 266 and the first through fourth keys 202, 206, 214, 218. Similarly, the mounting arrangement of the non-orbiting scroll member 130 to the bearing housing 34 will operate to effectively prevent relative rotation of the non-orbiting scroll member 130 with respect to bearing housing 34 and hence also prevent relative rotation of the orbiting scroll member 106 with respect to bearing housing 34.

The invention provides a new solution to a long standing problem by altering the physical construction of the Oldham coupling. Past attempts to solve the Oldham coupling failure focused on key wear as the basis for failure and have used wear resistant coatings and other measures to reduce key wear. In contrast, the focus of the present invention is on the structure surrounding the keys and not the keys themselves. Finite element analysis (FEA) was used to determine flaws in the existing designs and determine where loading and fatigue failures could be improved in typical Oldham couplings thereby leading to the present invention.

The Oldham couplings 178, 246 provide, among other things, an improvement over existing Oldham couplings by improving the wear resistance of the Oldham couplings 178, 246 without increasing the complexity or the weight and without the use of wear resistant coatings. Various features and advantages of the invention are set forth in the following claims.

What is claimed is:

1. A rotary compressor comprising:

a housing including a fluid inlet and a fluid outlet;

a first scroll member within the housing and positioned between the fluid inlet and the fluid outlet;

a second scroll member within the housing, positioned between the fluid inlet and the fluid outlet, and in meshing engagement with the first scroll member to compress a fluid from a first pressure in the inlet to a second higher pressure at the outlet; and an Oldham coupling positioned within the housing and coupled to the second scroll member to inhibit the relative rotational movement between the first scroll member and the second scroll member, the Oldham coupling including:

an annular ring including an upper surface, a lower surface, a first arc segment, a second arc segment, a first outwardly projecting flange portion extending out from the second arc segment, and a second outwardly projecting flange portion extending out from the second arc segment;

a first key positioned on the upper surface and centered with respect to the first arc segment;

a second key positioned on the upper surface and centered with respect to the second arc segment;

a third key positioned on the upper surface of the first outwardly projecting flange portion;

a fourth key positioned on the upper surface of the second outwardly projecting flange portion;

a first riding pad positioned on the upper surface and adjacent the first key;

a second riding pad positioned on the upper surface and adjacent the third key;

a third riding pad positioned on the lower surface and adjacent the third key; and a fourth riding pad positioned on the lower surface and adjacent the first key such that the first riding pad and the fourth riding pad are in an overlapping arrangement.

2. The rotary compressor of claim 1, wherein each of the first riding pad, the second riding pad, the third riding pad, and fourth riding pad includes a fillet.

3. The rotary compressor of claim 1, wherein the third riding pad and fourth riding pad include semi-circular end portions.

4. The rotary compressor of claim 1, wherein the first riding pad occupies at least twelve percent of the first arc segment;

wherein the third riding pad occupies at least twenty percent of the second arc segment; and wherein the fourth riding pad occupies at least twenty percent of the first arc segment.

5. The rotary compressor of claim 1, wherein the first arc segment defines a degree range from zero to one-hundred-eighty and the second arc segment defines a degree range from zero to one-hundred-eighty; and wherein the first riding pad occupies approximately forty degrees of the first arc segment;

wherein the third riding pad occupies approximately forty-five degrees of the second arc segment; and wherein the fourth riding pad occupies approximately forty-five degrees of the first arc segment.

6. The rotary compressor of claim 5, wherein the first and fourth riding pads overlap through approximately forty degrees of the first arc segment; and wherein the second and third riding pads overlap through approximately forty degrees of the second arc segment.

7. The rotary compressor of claim 1, wherein the second riding pad includes two legs; and wherein third riding pad is positioned such that the third riding pad is in an overlapping arrangement with both legs of the second riding pad.

8. The Oldham coupling of claim 1, wherein the first riding pad, the second riding pad, the third riding pad, and fourth riding pad are formed as a single piece with the annular ring and are made of the same material as the annular ring and project therefrom.

9. The Oldham coupling of claim 1, wherein the material is one of steel, aluminum, and titanium.

10. A rotary compressor comprising:

a housing including a fluid inlet and a fluid outlet;

a first scroll member within the housing and positioned between the fluid inlet and the fluid outlet;

a second scroll member within the housing, positioned between the fluid inlet and the fluid outlet, and in meshing engagement with the first scroll member to compress a fluid from a first pressure in the inlet to a second higher pressure at the outlet; and an Oldham coupling positioned within the housing and coupled to the second scroll member to inhibit the relative rotational movement between the first scroll member and the second scroll member, the Oldham coupling including:

an annular ring including an upper surface, a lower surface, a first arc segment, a second arc segment, a first outwardly projecting flange portion extending out from the second arc segment, and a second outwardly projecting flange portion extending out from the second arc segment;

a first key positioned on the upper surface and centered with respect to the first arc segment;

a second key positioned on the upper surface and centered with respect to the second arc segment;

a third key positioned on the upper surface of the first outwardly projecting flange portion;

a fourth key positioned on the upper surface of the second outwardly projecting flange portion;

a first riding pad positioned on the upper surface adjacent the first key and occupying at least twelve percent of the first arc segment;

a second riding pad positioned on the upper surface adjacent the third key;

a third riding pad positioned on the lower surface adjacent the third key and occupying at least twenty percent of the second arc segment; and a fourth riding pad positioned on the lower surface adjacent the first key and occupying at least twenty percent of the first arc segment.

11. The rotary compressor of claim 10, wherein each of the first riding pad, the second riding pad, the third riding pad, and fourth riding pad includes a fillet.

12. The rotary compressor of claim 10, wherein the third riding pad and fourth riding pad include semi-circular end portions.

13. The rotary compressor of claim 10, wherein the second riding pad and the third riding pad are in an overlapping arrangement; and wherein the first riding pad and the fourth riding pad are in an overlapping arrangement.

14. The rotary compressor of claim 10, wherein the first arc segment defines a degree range from zero to one-hundred-eighty and the second arc segment defines a degree range from zero to one-hundred-eighty; and wherein the first riding pad occupies approximately forty degrees of the first arc segment;

wherein the third riding pad occupies approximately forty-five degrees of the second arc segment; and wherein the fourth riding pad occupies approximately forty-five degrees of the first arc segment.

15. The rotary compressor of claim 14, wherein the first and fourth riding pads overlap through approximately forty degrees of the first arc segment; and wherein the second and third riding pads overlap through approximately forty degrees of the second arc segment.

16. The rotary compressor of claim 10, wherein the second riding pad includes two legs; and wherein third riding pad is positioned such that the third riding pad is in an overlapping arrangement with both legs of the second riding pad.

17. The Oldham coupling of claim 10, wherein the first riding pad, the second riding pad, the third riding pad, and fourth riding pad are formed as a single piece with the annular ring and are made of the same material as the annular ring and project therefrom.

18. The Oldham coupling of claim 10, wherein the material is one of steel, aluminum, and titanium.

19. An Oldham coupling comprising:

an annular ring including an upper surface, a lower surface, a first arc segment, a second arc segment, a first outwardly projecting flange portion extending out from the second arc segment, and a second outwardly projecting flange portion extending out from the second arc segment;

a first key positioned on the upper surface and centered with respect to the first arc segment;

a second key positioned on the upper surface and centered with respect to the second arc segment;

a third key positioned on the upper surface of the first outwardly projecting flange portion;

a fourth key positioned on the upper surface of the second outwardly projecting flange portion;

a first riding pad positioned on the upper surface, occupying at least twelve percent of the first arc segment, and adjacent the first key;

a second riding pad positioned adjacent the third key;

a third riding pad positioned on the lower surface, occupying at least twenty percent of the second arc segment, and adjacent the third key such that the second riding pad and the third riding pad are in an overlapping arrangement; and a fourth riding pad positioned on the lower surface, occupying at least twenty percent of the first arc segment, and adjacent the first key such that the first riding pad and the fourth riding pad are in an overlapping arrangement.

20. The Oldham coupling of claim 19, wherein the first arc segment defines a degree range from zero to one-hundred-eighty and the second arc segment defines a degree range from zero to one-hundred-eighty; and wherein the first riding pad occupies approximately forty degrees of the first arc segment;

wherein the third riding pad occupies approximately forty-five degrees of the second arc segment; and wherein the fourth riding pad occupies approximately forty-five degrees of the first arc segment.

21. The Oldham coupling of claim 20, wherein the first and fourth riding pads substantially overlap through approximately forty degrees of the first arc segment; and wherein the second and third riding pads overlap through approximately forty degrees of the second arc segment.

22. The Oldham coupling of claim 19, wherein the second riding pad includes two legs; and wherein third riding pad is positioned such that the third riding pad is in an overlapping arrangement with both legs of the second riding pad.

23. The Oldham coupling of claim 19, wherein each of the first riding pad, the second riding pad, the third riding pad, and fourth riding pad includes a fillet.

24. The Oldham coupling of claim 19, wherein the third riding pad and fourth riding pad include semi-circular end portions.

25. The Oldham coupling of claim 19, wherein the first riding pad, the second riding pad, the third riding pad, and fourth riding pad are formed as a single piece with the annular ring and are made of the same material as the annular ring and project therefrom.

26. The Oldham coupling of claim 19, wherein the material is one of steel, aluminum, and titanium.

* * * * *